US005720080A

United States Patent [19]

Rose

[11] Patent Number: 5,720,080

[45] Date of Patent: Feb. 24, 1998

[54] PATIO SCREEN DOOR CLOSURE

[75] Inventor: Gary T. Rose, Novi, Mich.

[73] Assignee: Brainstorms, LLC, Brighton, Mich.

[21] Appl. No.: 699,084

[22] Filed: Aug. 19, 1996

[51] Int. Cl.[6] ..... E05F 1/08

[52] U.S. Cl. ..... 16/74; 160/90; 49/404

[58] Field of Search ..... 160/90; 49/404; 16/71, 74

[56] References Cited

U.S. PATENT DOCUMENTS

| | | | |
|---|---|---|---|
| 4,003,102 | 1/1977 | Hawks et al. | 16/72 |
| 4,301,623 | 11/1981 | Demukai | 49/404 |
| 4,757,642 | 7/1988 | Hahn | 49/404 X |
| 4,819,295 | 4/1989 | Kaftan | 16/71 X |
| 4,891,911 | 1/1990 | Yung | 49/404 |
| 5,131,188 | 7/1992 | Hutchison et al. | 49/404 |
| 5,251,402 | 10/1993 | Richardson et al. | 49/404 |
| 5,313,739 | 5/1994 | Nelson et al. | 49/404 |
| 5,513,469 | 5/1996 | Tajudeen et al. | 49/404 |
| 5,579,607 | 12/1996 | Braid | 49/404 |

*Primary Examiner*—Blair Johnson
*Attorney, Agent, or Firm*—Charles W. Chandler

[57] ABSTRACT

A door closure for a patio sliding screen door includes an elastic band having one end connected to the sliding screen door and its opposite end connected to the door frame to bias the sliding screen door toward a closed position.

6 Claims, 3 Drawing Sheets

PATIO SCREEN DOOR CLOSURE

BACKGROUND OF THE INVENTION

This invention is related to a device for automatically closing a patio screen door.

Patio glass sliding doors are generally mounted in pairs in a rectangular frame. One glass door is moved from a fully closed position toward an open position parallel to the second glass door. It is common to have a sliding screen door disposed in the opening to prevent insects and the like from passing through the entrance.

Door closures are common in the prior art for closing a sliding glass door. Such door closures may be found in U.S. Pat. Nos. 4,003,102 which issued Jan. 18, 1977 to Nathaniel L. Hawks and John R. Shively, for a "Door and Window Closer"; 4,301,623 issued Nov. 24, 1981 to Enzo Demukai for a "Semiautomatic Sliding Door Device with Tension Spring"; 4,891,911 which was issued Jan. 9, 1990 to Victor J. L. Yung for "Sliding Door Closing Device"; 5,131,188 which was issued Jul. 21, 1992 to Davie G. Hutchison, and David M. Prochaska for "Automatic Return Mechanism for Sliding Door or Window"; and, 5,251,402 which was issued Oct. 12, 1993 to Richard J. Richardson and Charles E. Crown for "Self Return Mechanism". None of these devices are adapted for automatically closing a sliding screen door.

SUMMARY OF THE INVENTION

The broad purpose of the present invention is to provide a door closure for automatically closing a screen door mounted in a patio glass door assembly.

The preferred door closure comprises an elongated tubular frame that is mounted in the door opening parallel to the direction of motion of the screen door. Preferably the closure frame is attached to the horizontal head jamb at the top of the door frame. A taut elastic band is housed in the frame, one end being attached to the edge of the screen door. The other end of the elastic band is doubled around a roller in the far end of the frame. A strip of a fabric fastener material is attached to the frame. The end of the elastic band has a complementary patch of a fabric fastener that is connected in a selected position along the fabric strip in order to adjust the tension of the elastic band in biasing the screen door toward its closed position.

The closure can be easily mounted in the patio door assembly. It is reliable and assembled from a relatively few components into a compact assembly.

Still further objects and advantages of the present invention will become readily apparent to those skilled in the art to which the invention pertains upon reference to the detailed description.

DESCRIPTION OF THE DRAWINGS

The description refers to the accompanying drawings in which like reference characters refer to like parts throughout the several views and in which.

DESCRIPTION OF THE PREFERRED EMBODIMENTS

Figure 1:
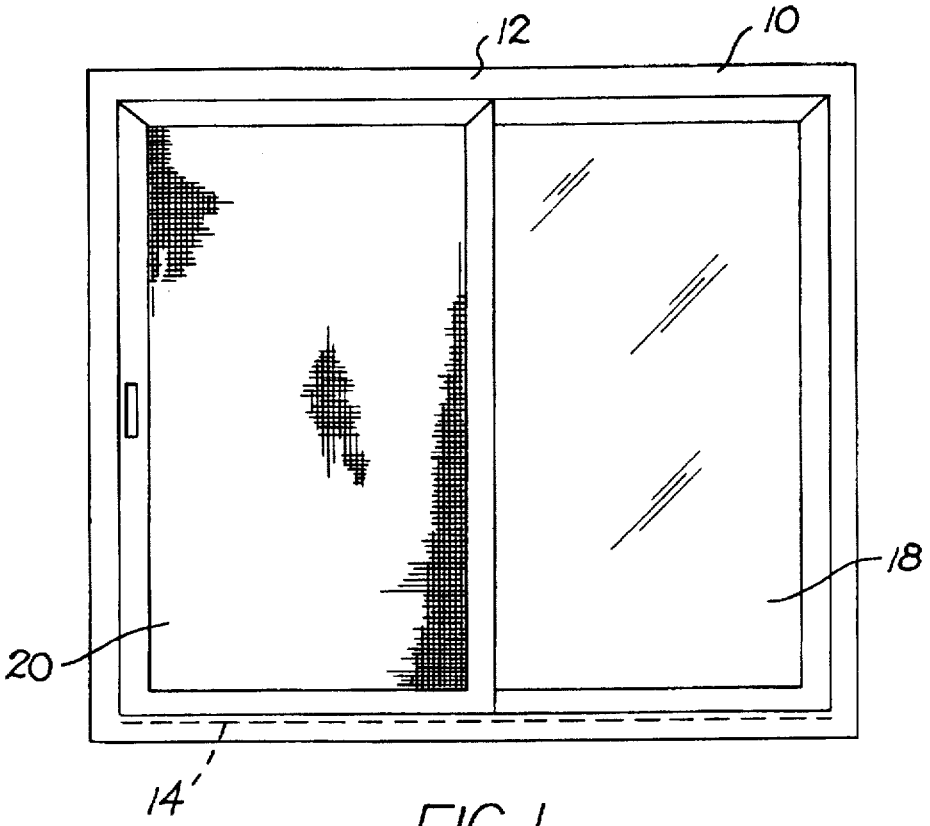
FIG. 1 is view of a patio door assembly showing the screen door in its fully closed position.
Figure 2:
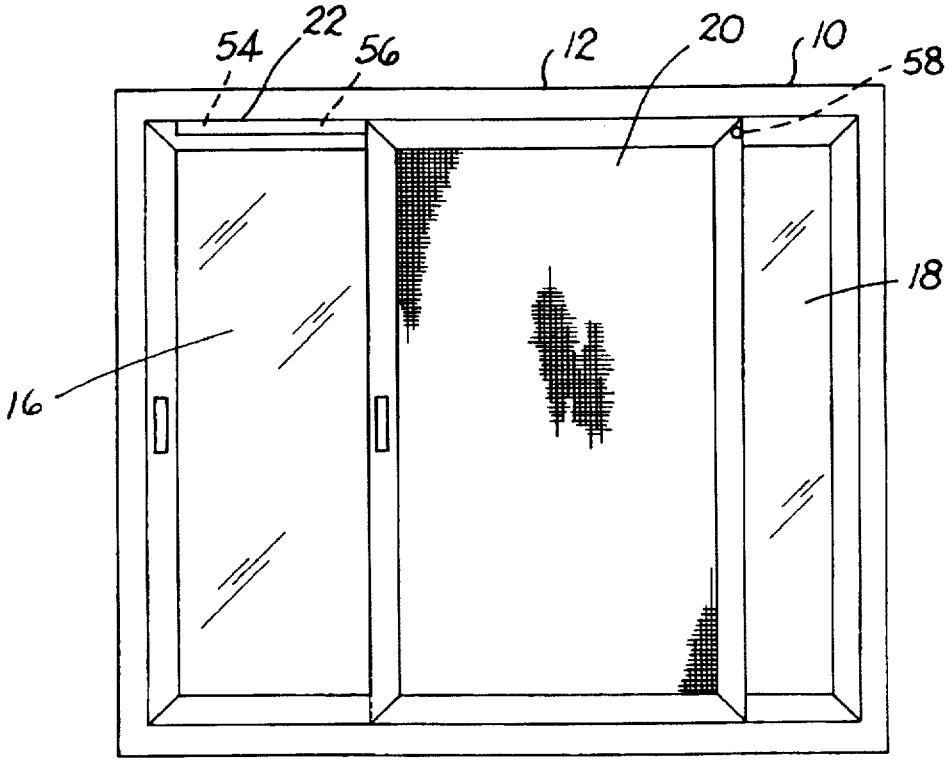
FIG. 2 is a view similar to FIG. 1 but showing the screen door in a partially open position.

Referring to the drawings, FIGS. 1 and 2 illustrate a conventional patio door assembly which comprises a generally rectangular frame 10 having a head jamb 12 and bottom horizontal track means 14. A pair of conventional glass sliding doors 16 and 18 are mounted within the door frame opening on the track means so that one of the sliding doors can be moved parallel to and adjacent the other sliding door to form an opening for the user to enter the residence.

A conventional screen door 20 is mounted on the track means and is slideably moveable in a plane parallel to the glass sliding doors. When one of the glass doors is in its open position to form an opening, the screen door can be moved to close the opening as illustrated in FIG. 1, to prevent insects from entering the interior of the residence.

FIG. 2 illustrates the screen door in a partially open position with both glass sliding doors fully closed.

Figure 3:
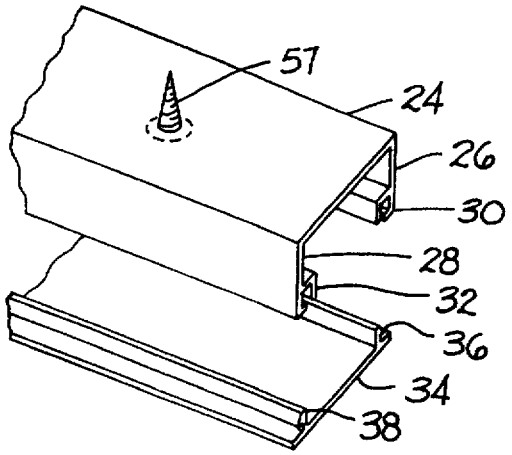
FIG. 3 is a view of one end of the closure housing.

An automatic screen door closure 22 is attached to horizontal head jamb 12. The door closure preferably comprises an elongated frame or channel 24, as illustrated in FIG. 3, having a pair of parallel sidewalls 26 and 28. The edges of the sidewalls have channel-shaped locking structures 30 and 32, respectively.

An elongated cover 34 has complementary dovetailed structures 36 and 38 which are snapped into locking structures 30 and 32 to form a four-sided housing. For illustrative purposes channel 24 is about 30" long and has an internal dimension between the side walls of ⅞" and an internal dimension between the cover and the base of the channel of about ½".

Figure 4:
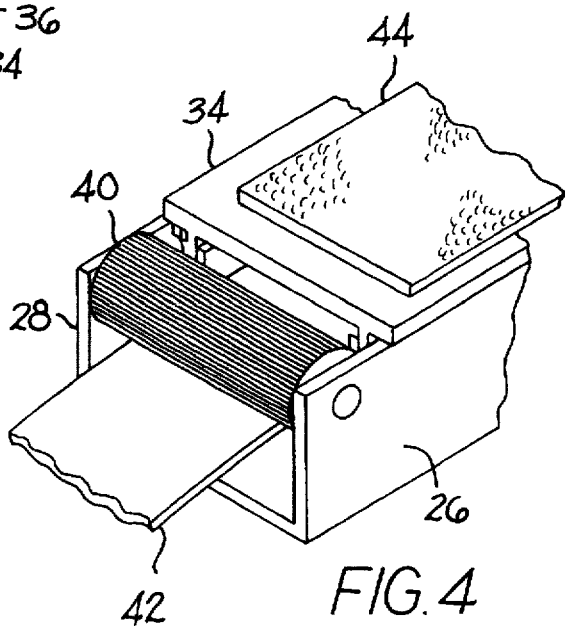
FIG. 4 is a view of the opposite end of the housing rotated about 180° from its normal mounting position to illustrate the roller.

Referring to FIG. 4, roller 40 has its ends journalled in the channel side walls so that when it is mounted on the patio door frame, the roller rotates about an axis generally perpendicular to the plane of the screen door.

Cover 34 is slightly shorter than the length of the channel so that the upper edge of the roller, as illustrated in FIG. 4, lies approximately in the plane of the outer edge of the cover. The roller is about 5/16" in diameter and made of a suitable plastic as are the channel and the cover.

A taut elastic band 42 from ½" to ¾" in width and from about 40" to 45" long is disposed in the housing. The band is twisted 90° and then doubled around the roller. The band can be stretched about 90% of its unstretched length.

Figure 5:
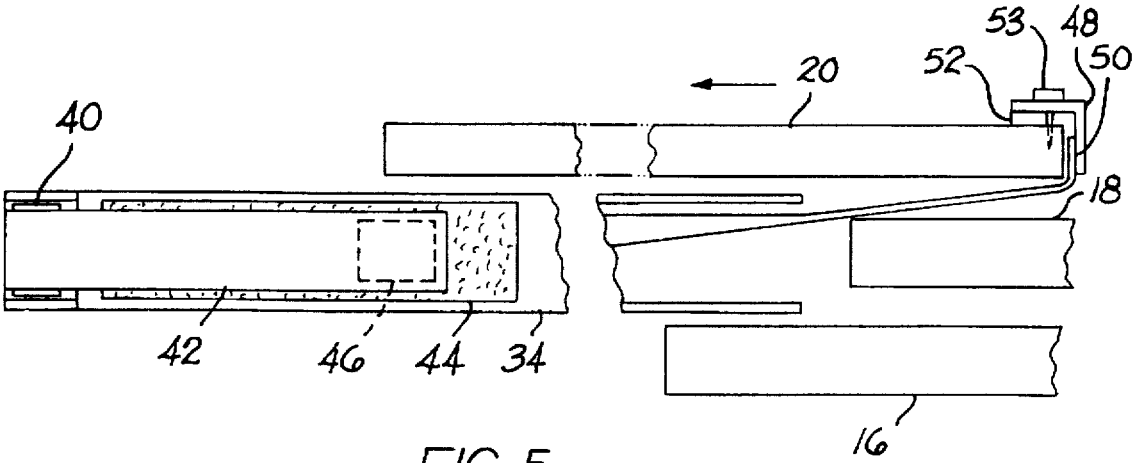
FIG. 5 is a partially sectional view of the closure showing the manner in which the elastic band is connected to the screen door.
Figure 6:
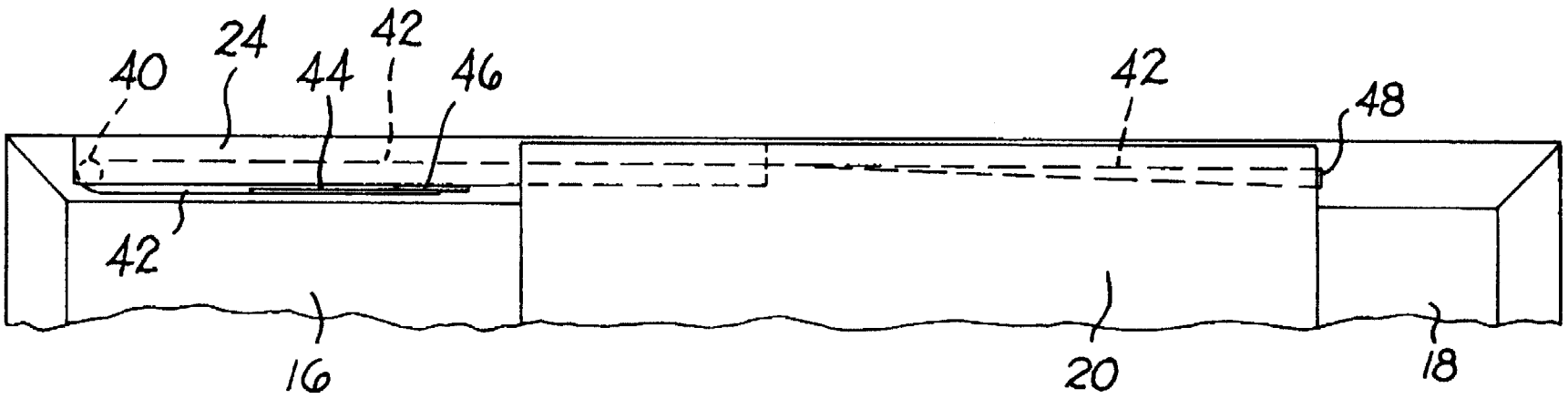
FIG. 6 is an enlarged fragmentary view taken in the same direction as FIG. 2, and showing features of a screen door closure not apparent from FIG. 2.

A strip 44 of a fabric fastener from about 12" to 16" long and ¾" wide is adhesively attached to cover 34. A patch 46 of a complementary fabric fastener is attached to what will be referred to as the inner end of the band as illustrated in FIG. 5. Patch 46 can be connected at any selected location along the length of strip 44 to adjust the tension of the elastic band.

An L-shaped bracket 48 is attached to the outer end 50 of the elastic band. Bracket 48 is attached around the outside edge of the screen door by a suitable means such as double-sided adhesive tape 52 or screw 53.

FIG. 5 shows the screen door in its partially opened position such that the elastic band is stretched to apply a tensile force urging the screen door toward its fully closed position in which its opposite vertical side abuts the side of the patio door frame. The elastic band can be stretched over 2 feet to apply a biasing force on the screen door. The fabric fastener means 44 and 46 permit the location of the inner end of the elastic band to be adjusted to adjust the bias urging the screen door toward its fully closed position, and also to adjust for any tendency of the elastic band to acquire an elongation over a period of time.

The mounting procedure is to remove the channel cover from the channel. The channel is then attached to the head jamb as at 54 and 56 by metal screw means 57, as shown in FIG. 3, approximately ½" from the door jamb which engages sliding door 16.

Using an alcohol prep pad (not shown), the exterior of the screen door is closed at the location generally indicated at 58. L-shaped bracket 48 is taped and/or screwed to the screen door as shown in FIGS. 2 and 5. The elastic band is fed between the screen door and the stationary glass door. The band is twisted 90° and then wrapped around roller 40 and the inner end of the band connected to strip 44 on the cover. The position of the inner end of the elastic band is adjusted to adjust the tautness of the band to achieve the desired door closure force. The cover is snapped on the channel.

Having described my invention, I claim:

1. A door closure for a patio sliding screen door mounted in a patio glass door frame having a head jamb, wherein said sliding screen door has an open position and a closed position; said door closure comprising:

an elongated tubular housing securable to the head jamb in the space above the sliding screen door when the sliding screen door is in its closed position; said tubular housing having a first end locatable at a central point approximately midway along the length of the head jamb and a second end locatable proximate to one end of the head jamb; said tubular housing having a lower exposed surface, said lower exposed surface having anchoring means;

a guide roller mounted in said tubular housing at the second end thereof;

a stretchable flat elastic band having a first end connectable to the screen door and a second end having a connecting portion connected to said anchoring means the lower exposed surface of said tubular housing; and said flat elastic band being extendable from its first end through said tubular housing around said guide roller and along the exposed lower surface of said tubular housing wherein said attachment portion is connected to said anchoring means.

2. A door closure as defined in claim 1, wherein said tubular housing comprises a channel having downwardly extending side walls, and a cover releasably attached to the channel side walls.

3. A door closure as defined in claim 2, wherein each channel side wall has a snap action lock structure releasably engaged with an edge area of said cover, to achieve a releasable connection between the cover and the channel.

4. A door closure as defined in claim 1, wherein said anchoring means on the exposed lower surface of said tubular housing connects said second end of said elastic band to said lower surface at different selected positions along said lower surface, thereby adjusting the tensile force of the elastic band when the screen door is in its open position.

5. A door closure as defined in claim 4, wherein said anchoring means comprises an elongated attachment strip extending along the lower surface of the tubular housing; said connecting portion comprises a mating patch of fastener material attachable to different selected areas of said elongated attachment strip.

6. A door closure for a patio sliding screen door mounted in a patio glass door frame having a head jamb, wherein said sliding screen door has an open position and a closed position; said door closure comprising:

an elongated tubular housing securable to the head jamb in the space above the sliding screen door when the sliding screen door is in its closed position; said tubular housing having a first end locatable at a central point approximately midway along the length of the head jamb and a second end locatable proximate to one end of the head jamb; said tubular housing having a lower exposed surface;

a guide roller mounted in said tubular housing at the second end thereof;

a stretchable flat elastic band having a first end connectable to the screen door and a second end connected to the lower exposed surface of said tubular housing;

said flat elastic band extending from its first end through said tubular housing, around said guide roller, and along the exposed lower surface of said tubular housing;

said tubular housing comprising a channel having downwardly extending side walls, and a cover releasably attached to the channel side walls, each channel side wall having a snap action lock structure releasably engaged with an edge area of said cover, to achieve a releasable connection between the cover and the channel;

an elongated attachment strip extending along the lower exposed surface of the tubular housing; the second end of said elastic band having a mating patch of fastener material attachable to different selected areas of said elongated attachment strip, to adjust the tensile force of the elastic band when the screen door is in its open position.

* * * * *